United States Patent [19]

Froes et al.

[11] Patent Number: 4,808,250

[45] Date of Patent: Feb. 28, 1989

[54] METHOD FOR REFINING MICROSTRUCTURES OF BLENDED ELEMENTAL TITANIUM POWDER COMPACTS

[75] Inventors: Francis H. Froes, Xenia; Daniel Eylon, Dayton, both of Ohio

[73] Assignee: The United States of America as represented by the Secretary of the Air Force, Washington, D.C.

[21] Appl. No.: 128,840

[22] Filed: Dec. 4, 1987

[51] Int. Cl.[4] ..... C22F 1/18

[52] U.S. Cl. ..... 148/20.3; 148/11.5 F; 148/11.5 P; 148/133

[58] Field of Search ..... 148/11.5 F, 11.5 P, 148/133, 20.3

[56] References Cited

U.S. PATENT DOCUMENTS 4,534,808 8/1985 Eylon et al. ..... 148/133
4,536,234 8/1985 Eylon et al. ..... 148/133
4,680,063 7/1987 Vogt et al. ..... 148/11.5 F

OTHER PUBLICATIONS

Kerr et al., in Titanium '80, ed. Kimura et al., Met. Soc. AIME, Warrendale, Pa., 1980, p. 2477.

*Primary Examiner*—Upendra Roy
*Attorney, Agent, or Firm*—Charles E. Bricker; Donald J. Singer

[57] ABSTRACT

A method for improving the microstructure of blended elemental titanium alloy compacted articles which comprises the steps of hydrogenating the article at a temperature of about 780° to 1020° C. to a hydrogen level of about 0.50 to 1.50 weight percent, cooling the thus-hydrogenated article to room temperature at a controlled rate, heating the thus-cooled, hydrogenated article to a temperature of about 650° to 750° C. and applying a vacuum to dehydrogenate the article, and cooling the thus-dehydrogenated article to room temperature at a controlled rate.

8 Claims, 2 Drawing Sheets

450X

600X

METHOD FOR REFINING MICROSTRUCTURES OF BLENDED ELEMENTAL TITANIUM POWDER COMPACTS

RIGHTS OF THE GOVERNMENT

The invention described herein may be manufactured and used by or for the Government of the United States for all governmental purposes without the payment of any royalty.

BACKGROUND OF THE INVENTION

This invention relates to the processing of titanium articles fabricated by powder metallurgy to improve the microstructure of such articles.

In general terms, powder metallurgy involves production, processing and consolidation of fine particles to produce a solid article. The small, homogeneous powder particles result in a uniform microstructure in the final product. If the final product is made net-shape by application of hot isostatic pressing (HIP), a lack of texture can result, thus giving equal properties in all directions.

Titanium powder metallurgy is generally divided into two "approaches", the "elemental approach" and the "pre-alloyed approach". With the "elemental approach", the small (−100 mesh) regular grains of titanium normally rejected during the conversion of ore to ingot (commonly called "sponge fines"), are used as starting stock. Alloy additions, normally in the form of a powdered master alloy, are made to these fines, so that the desired bulk chemistry is achieved. The blended mixture is then compacted cold, under pressures up to 420 MPa (60 ksi), to a density of 85–90%. This operation can be carried out either isostatically or with a relatively simple mechanical press. The "green" compact is then sintered to increase density to 95–99.8% theoretical density and to homegenize the chemistry. The cold isostatic pressing is often referred to as CIP. A further increase in density can be achieved by hot isostatic pressing the article, which also generally improves the mechanical properties of the article. The combined cold/hot isostatic pressing process is referred to as CHIP.

The CHIP process using elastomeric molds can produce extremely complex shapes, which are very difficult to achieve by forging processes. Caution must be used in applying parts made by this technique in critical components, such as rotating parts, where fatigue behavior is usually very important. Available data indicate that parts made from elemental material are inferior to wrought material in fatigue performance.

With the "pre-alloyed approach", spherical pre-alloyed powder is used. Spherical powder flows readily, with minimal bridging tendency, and packs to a very consistent density (approximately 65%). This leads to excellent part-to-part dimensional reproducibility. Pre-alloyed powder is generally HIP'd or otherwise hot pressed. Parts made from pre-alloyed powder generally exhibit better fatigue performance than those made of elemental powder, but are somewhat inferior to wrought material.

While mechanical working can be used on wrought articles to modify their structures and enhance properties, such treatment is not practical for net shape articles produced from powder. Eylon et al describe in U.S. Pat. Nos. 4,534,808 and 4,536,234, methods for refining the microstructure of articles made by powder metallurgy which generally comprise the steps of beta-solution heat treating the article for a relatively brief time, quenching the article, aging the article at a suitable temperature and air cooling the article to room temperature. These methods provide articles having a fine alpha plate microstructure in a matrix of a discontinuous beta phase, which exhibit increased fatique strength.

We have found that the microstructure of net shape blended elemental titanium powder compacts can be improved in such a way that the compact will be able to tolerate the microvoids which are typical of this material.

Accordingly it is an object of the present invention to provide a process for improving the microstructure of titanium articles made by the powder metallurgy of blended elemental titanium alloy powder.

Other objects, aspects and advantages of the present invention will become apparent to those skilled in the art after reading the detailed description of the invention as well as the appended claims.

SUMMARY OF THE INVENTION

In accordance with the present invention there is provided a process for improving the microstructure of a blended elemental titanium article made by powder metallurgy which comprises, in combination, the steps of hydrogenating the compacted article at a temperature of about 780° to 1020° C. to a hydrogen level of about 0.50 to 1.50 weight percent, cooling the thus-hydrogenated article to room temperature at a controlled rate, heating the thus-cooled, hydrogenated article to a temperature of about 650° to 750° C. and applying a vacuum to dehydrogenate the article, and cooling the thus-dehydrogenated article to room temperature at a controlled rate.

DESCRIPTION OF THE INVENTION

Figure 1:
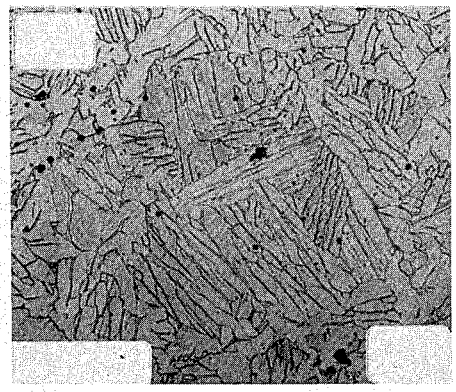
FIG. 1 is a 450 x photomicrograph illustrating the microstructure of an article made by powder metallurgy of blended elemental Ti-6Al-4V.

The starting stock for production of net shape articles by powder metallurgy contains the desired alloy components. Suitable powders, when compounded, include, for example, the alloys: Ti-6Al-4V, Ti-6Al-6V-2Sn, Ti-6Al-2Sn-4Zr-2Mo, Ti-5Al-2.5Sn, Ti-2.5Al-13V-7Sn-2Zr, Ti-10V-2Fe-3Al, Ti-11.5Mo-6Zr-4.5Sn, Ti-5Al-6Sn-2Zr-1Mo-0.2Sn, Ti-6Al-2Sn-4Zr-6Mo, Ti-5Al-2Sn-2Zr-4Mo-4Cr, Ti-8Mo-8V-2Fe-3Al, Ti-3Al-8V-6Cr-4Mo-4Zr, Ti-13V-11Cr-3Al and the like.

Consolidation of the powder may be accomplished using any procedure known in the art. Following consolidation, the formed article may optionally be subjected to an annealing heat treatment. Such treatment is typically carried out at a temperature about 20 to 30% below the beta-transus temperature (in ° C.) of the alloy for about 2 to 36 hours in a vacuum or inert environment to protect the surface of the article from oxidation. For example, heat treatment of Ti-6Al-4V alloy is typically carried out between 700° and 800° C. for about 2 to 8 hours.

Following consolidation, and optionally, the annealing step, the article is hydrogenated. Titanium and its alloys have an affinity for hydrogen, being able to dissolve up to about 3 weight percent (60 atomic %) hydrogen at 590° C. While it may be possible to hydrogenate the article to the maximum quantity, it is presently preferred to hydrogenate the article to a level of about 0.5 to 1.5 weight percent hydrogen to prevent cracking of the article during the subsequent cooling step.

Hydrogenation is conducted in a suitable, closed apparatus at an elevated temperature by admitting sufficient hydrogen to attain the desired concentration of hydrogen in the alloy. The hydrogenation step is conducted at a temperature of about 780° to 1020° C. Heating of the article to the desired temperature is conducted under an inert atmosphere. When the hydrogenation temperature is reached, hydrogen is added to the atmosphere within the apparatus. The partial pressure of hydrogen added to the atmosphere and the time required for hydrogenation are dependent upon such factors as the size and cross-section of the article, the temperature of hydrogenation and the desired concentration of hydrogen in the article.

A typical composition for the non-flammable gas environment would be a mixture consisting of 96 weight percent argon and 4 wright percent hydrogen, i.e., hydrogen makes up about 43 volume percent of the gas mixture. The composition of the gas is not critical, but it is preferred that the quantity of hydrogen be less than about 5 weight percent to avoid creation of a flammable mixture.

Following the hydrogenation step, the article is cooled from the hydrogenation temperature at a controlled rate to about room temperature. The rate is controlled to be about 5° to 40°C. per minute. This controlled rate cooling step is critical to providing the desired microstructure. If the rate is too high, cracking and distortion of the article may result. A slower cooling rate may lead to the formation of a coarse lenticular structure which will not provide satisfactory fatigue properties.

While we do not wish to be held to any particular theory of operation, it is believed that as the hydrogenated article cools, metal hydrides, particularly titanium hydrides, form within the matrix of alpha and beta titanium. Because the metal hydrides have a different volume than the titanium matrix grains, there is initiated localized deformation on a microscopic scale. As a result, when the material is reheated for removal of the hydrogen, the microdeformed regions cause localized recrystallization which results in a low aspect ratio grain structure or breakup of the plate structure.

Dehydrogenation of the hydrogenated article is accomplished by heating the article under vacuum to a temperature in the range of about 650° to 750° C., (1200° to 1380° F.). The time for the hydrogen removal will depend on the size and cross-section of the article, the volume of hydrogen to be removed, the temperature of dehydrogenation and the level of vacuum in the apparatus used for dehydrogenation. The term "vacuum" is intended to mean a vacuum of about $10^{-2}$ mm Hg or less, preferably about $10^{-4}$ mm Hg or less. The time for dehydrogenation must be sufficient to reduce the hydrogen content in the article to less than the maximum allowable level. For the alloy Ti-6Al-4V, the final hydrogen level must be below 120 ppm to avoid degradation of physical properties. Generally, about 15 to 60 minutes at dehydrogenation temperature and under vacuum, is sufficient to ensure substantially complete evolution of hydrogen from the article. Heating is then discontinued and the article is allowed to cool, at the previously described controlled rate, to room temperature.

Figure 2:
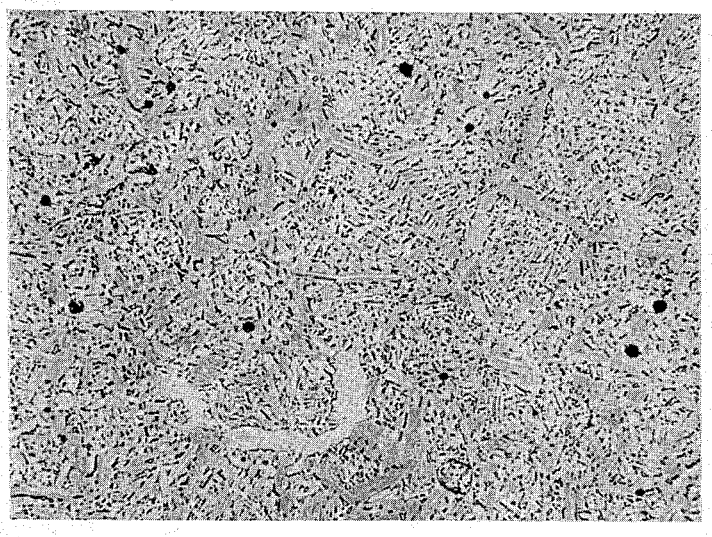
FIG. 2 is a 600 x photomicrograph illustrating the microstructure of an article made by powder metallurgy of blended elemental Ti-6Al-4V and treated in accordance with the present invention; and, FIG. 3 is a graph illustrating the smooth axial fatigue strength of a treated Ti-6Al-4V powder compact.
Figure 3:
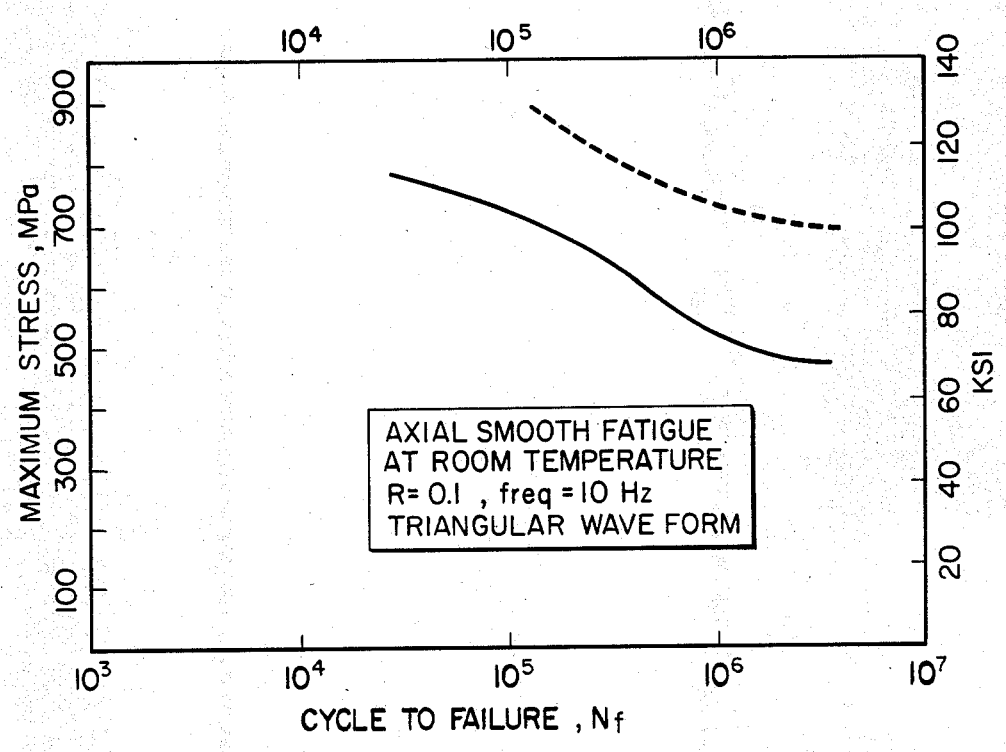

The benefits of the method of this invention are illustrated in FIGS. 1–3. A typical microstructure of a consolidated article prepared by powder metallurgy of blended elemental Ti-6Al-4V powder is shown in FIG. 1. The structure is a mixture of low and high aspect ratio coarse alpha plates separated by a continuous beta phase.

FIG. 2 illustrates a structure resulting from hydrogenation/dehydrogenation in accordance with the present invention. This microstructure is much finer than the as-consolidated structure.

FIG. 3 illustrates the smooth axial fatigue strength of a compact prepared by consolidating blended elemental Ti-6Al-4V powder. The solid line represents the fatigue data of the untreated compacts. The broken line represents the increased fatigue strength of compacts which were treated in accordance with the invention as follows: hydrogenated at 1550° F. to a hydrogen level of 0.7 weight percent, cooled to room temperature at a controlled rate, dehydrogenated at 1300° F. and cooled to room temperature at a controlled rate.

EXAMPLE

A series of compacts were prepared by consolidating blended elemental Ti-6Al-4V powder. A portion of the compacts were hydrogenated as shown in Table I, below, then cooled to room temperature, dehydrogenated at about 1300° F., and cooled to room temperature. The tensile properties of HIP'd compacts are compared to compacts hydrogenated at 1550° F. in accordance with the invention in Table II, below.

TABLE I

| Hydrogenation Temperature (°F.) | Hydrogen, wt. % |
|---|---|
| 1450 | 1.118 |
| 1500 | 0.995 |
| 1550 | 0.820 |
| 1600 | 0.732 |
| 1650 | 0.986 |

TABLE II

| Material Condition | 0.2% YS, MPa (Ksi) | UTS MPa (Ksi) | EL, % | RA, % |
|---|---|---|---|---|
| Untreated | 841 (122) | 910 (132) | 18 | 40 |
| Treated | 1007 (146) | 1062 (154) | 14 | 20 |

The method of this invention is generally applicable to the manufacture of aircraft components, as well as non-aerospace components. This method is particularly applicable to the production of fatigue-resistant titanium alloy articles, such as, for example, aircraft engine mount supports, load carrying wing sections and nacelles, turbine engine compressor blades and the like, as well as articles for surgical body implantation, such as hip joints.

Various modifications may be made to the present invention without departing from the spirit and scope of the invention.

We claim:

1. A method for improving the microstructure of an article made by powder metallurgy of blended elemental titanium alloy powder which comprises, in combination, the steps of hydrogenating the consolidated article at a temperature of about 780° to 1020° C. to a hydrogen level of about 0.50 to 1.50 weight percent, cooling the thus-hydrogenated article to room temperature at a controlled rate, heating the thus-cooled, hydrogenated article to a temperature of about 650° to 750° C., applying a vacuum to dehydrogenate the article and cooling said article to room temperature at a controlled rate.

2. The method of claim 1 wherein said controlled cooling rate is about 5° to 40° C. per minute.

3. The method of claim 1 wherein said article is made of Ti-6Al-4V alloy.

4. The method of claim 3 wherein said hydrogenation is carried out at a temperature of about 1450° F. (787° C.) to a hydrogen level of about 1.118 wt. percent and wherein said dehydrogenation is carried out at about 1300° F. (704° C).

5. The method of claim 3 wherein said hydrogenation is carried out at a temperature of about 1500° F. (815° C.) to a hydrogen level of about 0.995 wt. percent and wherein said dehydrogenation is carried out at about 1300° F. (704° C.).

6. The method of claim 3 wherein said hydrogenation is carried out at a temperature of about 1550° F. (843° C.) to a hydrogen level of about 0.82 wt. percent and wherein said dehydrogenation is carried out at about 1300° F. (704° C.).

7. The method of claim 3 wherein said hydrogenation is carried out at a temperature of about 1600° F. (871° C.) to a hydrogen level of about 0.732 wt. percent and wherein said dehydrogenation is carried out at about 1300° F. (704° C.).

8. The method of claim 3 wherein said hydrogenation is carried out at a temperature of about 1650° F. (899° C.) to a hydrogen level of about 0.986 wt. percent and wherein said dehydrogenation is carried out at about 1300° F. (704° C.).

* * * * *